US011236531B2

(12) United States Patent
Parsons et al.

(10) Patent No.: US 11,236,531 B2
(45) Date of Patent: Feb. 1, 2022

(54) FLEXIBLE ONE-TIME USE RESTRAINTS

(71) Applicant: Armament Systems and Procedures, Inc., Appleton, WI (US)

(72) Inventors: Kevin Parsons, Appleton, WI (US); Siu Ngai Wang, Kowloon (HK)

(73) Assignee: ARMAMENT SYSTEMS AND PROCEDURES, INC., Appleton, WI (US)

( * ) Notice: Subject to any disclaimer, the term of this patent is extended or adjusted under 35 U.S.C. 154(b) by 431 days.

(21) Appl. No.: 16/251,418

(22) Filed: Jan. 18, 2019

(65) Prior Publication Data

US 2020/0232258 A1 Jul. 23, 2020

(51) Int. Cl.
*E05B 75/00* (2006.01)

(52) U.S. Cl.
CPC ..... *E05B 75/00* (2013.01)

(58) Field of Classification Search
CPC ..... E05B 75/00; B65D 63/00
USPC ..... 70/16
See application file for complete search history.

(56) References Cited

U.S. PATENT DOCUMENTS

| | | | | |
|---|---|---|---|---|
| 4,910,831 | A | 3/1990 | Bingold | |
| 5,377,510 | A | 1/1995 | Smith | |
| 5,797,404 | A | 8/1998 | Stanchin, II | |
| 5,802,675 | A | 9/1998 | Parsons | |
| 5,802,888 | A | 9/1998 | Parsons | |
| 6,101,682 | A | 8/2000 | Parsons | |
| 6,219,887 | B1 | 4/2001 | Parsons | |
| 6,334,444 | B1 | 1/2002 | Sisco | |
| 7,882,599 | B2 | 2/2011 | Harrington | |
| 8,539,798 | B2 | 9/2013 | Harrington | |
| 9,194,161 | B2 | 11/2015 | Parsons et al. | |
| 9,555,943 | B2 * | 1/2017 | Breen, IV | A44B 11/06 |
| 2008/0047307 | A1 * | 2/2008 | Kenney | E05B 75/00 70/16 |
| 2010/0269548 | A1 | 10/2010 | Harrington | |

(Continued)

FOREIGN PATENT DOCUMENTS

GB 2553305 7/2018

OTHER PUBLICATIONS

International Search Report and Written Opinion of the International Searching Authority dated Mar. 11, 2020 (9 pgs.).

*Primary Examiner* — Suzanne L Barrett
(74) *Attorney, Agent, or Firm* — Hahn Loeser & Parks LLP

(57) ABSTRACT

A disposable, flexible locking restraint having a base and first and second straps integrally molded of a dry flexible plastic is provided. During use, toothed portion of the straps engage toothed portions of associated pawls to provide for unidirectional travel of the straps through the base. For increased security, pawl locks are provided on the base. Each pawl lock has first and second retainers to engage the pawl lock on the base, where the first retainer is spaced from the second retainer along a length of the pawl lock. When the first retainer retains the pawl locks in the base, the pawls have sufficient freedom of movement to allow unidirectional movement of the straps through the base, and when the pawl locks are depressed such that the second retainer retains each pawl lock in its respective lock aperture, the pawl lock engages the pawl and presses the pawl against the strap, preventing further travel of the strap.

18 Claims, 4 Drawing Sheets

(56) References Cited

U.S. PATENT DOCUMENTS

| | | | | |
|---|---|---|---|---|
| 2010/0306967 | A1* | 12/2010 | Geiger | F16L 3/2334<br>24/16 PB |
| 2012/0291231 | A1 | 11/2012 | Ku | |
| 2013/0205545 | A1* | 8/2013 | Zantout | B65D 63/1072<br>24/16 R |
| 2015/0107311 | A1* | 4/2015 | Parsons | E05B 75/00<br>70/16 |
| 2020/0232259 | A1* | 7/2020 | Parsons | B65D 63/1072 |

* cited by examiner

FLEXIBLE ONE-TIME USE RESTRAINTS

FIELD OF INVENTION

The subject invention is generally related to restraining devices for use by law enforcement personnel and is specifically directed to one-time use restraining devices formed from flexible plastic which does not require water conditioning and having flexible straps which can be formed into two secure loops.

BACKGROUND

Restraining devices for restraining detainees are well known and have been available for many years. A well-known example of a restraining device is a pair of handcuffs. While traditional handcuffs serve the purpose of restraining an individual, they have a number of drawbacks. Conventional handcuffs are heavy, bulky to carry, expensive, require a key and are often inconvenient, particularly in multiple arrest situations. Because of these drawbacks, it has become more and more desirable to provide handcuffs which are lightweight, inexpensive and do not require a key. Moreover, it has become desirable to use disposable, one-time use handcuffs, particularly in multiple arrest situations.

Further, there has been a movement toward using one-time use handcuffs due to the increasing concern of the risk of spreading of disease, such as AIDS or Hepatitis, since restrained individuals who struggle violently often create open wounds which result in blood on the handcuffs. Disposable handcuff restraints are cut to be removed, thereby assuring that the restraints will not be reused. Disposing of the restraints prevent them from becoming a carrier for communicable diseases through contamination due to cuts or abrasions an individual may have received during the detainment.

One-time use handcuff restraints are available which address some of the problems of conventional key-operated handcuffs. For example, U.S. Pat. No. 5,802,675, which is incorporated by reference, discloses a double loop molded restraining device. Sawtooth-ribbed teeth are molded into the straps and an interlocking cover. The teeth engage as the strap is inserted, and do not allow the straps to be simply pulled out of the locking cover. However, to be of sufficient strength, such known restraints typically are made from a strong yet flexible material, such as nylon.

Nylons are moisture sensitive and absorb water (hydroscopic). As such, nylons may be characterized in two states, dry and conditioned. A conditioned nylon is one which has absorbed water. For example, at equilibrium, materials like nylon 6, nylon 6/6, and nylon 4/6 can hold approximately 1.5-2% of their weight in water. This value can be substantially higher if the nylon is immersed in water and is allowed to reach a saturation point.

The water content of nylons may be controlled to modify a nylon's properties of strength, flexibility, and brittleness. For example, nylon becomes increasingly flexible as moisture is absorbed. The strength and stiffness of the conditioned nylon is lower than dry nylon, but brittleness is also lowered, significantly improving damage resistance.

Nylon one-time use restraints may be moisture conditioned by pouring a predetermined amount of water into moisture-proof packaging for the restraints. During shipment and storage, the nylon restraints absorb the water and achieve a desired state of strength, flexibility, and impact resistance.

However, once nylon restraints are removed from their packaging, they may experience undesirable drying out and deconditioning. For example, it may be desirable to pre-fold the nylon restraints and carry them on one's person for quick and efficient use. This typically requires that they be removed from their package. Also, nylon restraints are typically used in environments where relative humidity and temperature are not controlled (such as outdoors), and may be carried in a prepared state for extended periods of time. For example, use outdoors in northern climates in the winter may dry the water out and decondition the nylon restraints. Heat may also adversely affect the conditioning. If a nylon handcuff restraint is deconditioned to close to its dry-as-molded state and is subjected to high loads, large flexures, or impacts, the nylon restraints may exhibit brittle failure. Pre-folded nylon handcuff restraints may be subject to all of these stresses.

A plastic which is flexible and not brittle in its dry-as-molded state, such as polyethylene, may be used for one-time restraints. Polyethylene is also less sensitive to heat and cold than nylon. These properties avoid the brittle failure disadvantage of nylon. However, flexible polyethylenes and other plastics are considerably softer than nylon. In particular, the plastics may be so soft as to allow a sufficiently strong individual to pull straps out, destroying the locking teeth in the process. In some designs, a load of as little as 70 pounds may damage the teeth and result in a failure of the handcuff restraint.

SUMMARY

A flexible locking strap having a base and at least one strap integrally molded of a dry flexible plastic is provided. The dry flexible plastic may comprise a polyethylene, such as low density polyethylene. The strap extends outwardly from a first side of the base and has a proximal end and a distal end. The strap further has a first surface and a second surface, the first surface comprising at least one toothed portion.

The base comprises a strap aperture disposed on the first side of the base proximate to the proximal end of the strap and being dimensioned to accept the distal end of the strap, a lock aperture disposed on a second side of the base, a pawl extending inwardly from the first side of the base and having a first surface facing the strap aperture and a second surface facing the lock aperture, the first surface of the pawl comprising a toothed surface to cooperate with the toothed portions of the strap, and a pawl lock disposed in the lock aperture, the pawl lock having first and second retainers to engage the lock aperture, where the first retainer is spaced from the second retainer along a length of the pawl lock. When the first retainer retains the pawl lock in the lock aperture and the distal end of the strap is inserted into the strap aperture with the first surface oriented toward the pawl such that the toothed portion of the strap and the toothed surface of the pawl engage, the pawl has sufficient freedom of movement to allow unidirectional movement of the strap through the base, and when the pawl lock is depressed such that the second retainer retains the pawl lock in the lock aperture, the pawl lock engages the pawl and presses the pawl against the strap.

The pawl lock may comprise a button with a button head and a shaft, and the first and second retainers comprise first and second barbs disposed on the shaft. The lock aperture may further comprise a recessed portion to facilitate pawl lock barb passage and to receive at least a portion of the button head. The pawl lock may be formed from plastic which is harder than the dry flexible plastic.

The flexible locking strap may further comprise a hard plastic anti-tamper cover disposed on a third side of the base opposite from the first side of the base. The hard plastic of anti-tamper cover may be acetal.

The first surface of the strap may comprise a plurality of toothed portions. The strap may further comprise at least one flexible hinge portion between toothed portions. The pawl may comprise one side of the strap aperture.

In another example, a disposable, flexible locking restraint having a base and first and second straps integrally molded of a dry flexible plastic is provided. The first and second straps each extending outwardly from a first side of the base and have a proximal end and a distal end. Each strap further has a first surface and a second surface, the first surface comprising at least one toothed portion.

The base further comprises first and second strap apertures disposed on the first side of the base proximate to the proximal ends of the first and second straps, respectively and being dimensioned to accept the distal end of their respective strap, a first lock aperture disposed on a second side of the base, a second lock aperture disposed on a third side of the base opposite the second side of the base, a first pawl extending inwardly from the first side of the base and having a first surface facing the first strap aperture and a second surface facing the first lock aperture, the first surface of the pawl comprising a toothed surface to cooperate with the toothed portions of the first strap, a second pawl extending inwardly from the second side of the base and having a first surface facing the second strap aperture and a second surface facing the second lock aperture, the first surface of the pawl comprising a toothed surface to cooperate with the toothed portions of the second strap, and a first pawl lock disposed in the first lock aperture and a second pawl lock disposed in the second lock aperture, each pawl lock having first and second retainers to engage their respective lock apertures, where the first retainer is spaced from the second retainer along a length of the pawl lock. When the first retainer retains the pawl locks in the lock aperture and the distal ends of the straps are inserted into their respective strap apertures with the first surfaces oriented toward the pawls such that the toothed portion of the strap and the toothed surface of the pawl engage, the pawls have sufficient freedom of movement to allow unidirectional movement of the straps through the base, and when the pawl locks are depressed such that the second retainer retains each pawl lock in its respective lock aperture, the pawl lock engages the pawl and presses the pawl against the strap.

Each pawl lock may comprise a button with a button head and a shaft, and the first and second retainers may comprise first and second barbs disposed on the shaft. The first and second barbs may completely encircle the shaft.

Each pawl lock may be formed from a plastic which is harder than the dry flexible plastic, such as acetal. Each pawl lock may be formed from a plastic which is a different color from the dry flexible plastic.

A cover aperture may be provided on the base opposite from the first side of the base. The flexible locking strap may further comprise an anti-tamper cover disposed in the cover aperture. The anti-tamper cover has first and second strap exit apertures positioned to pass the first and second straps, respectively, yet block tools and/or blades from being able to release the pawls. The anti-tamper cover further includes first and second cover retainers, each having a retainer aperture, and the anti-tamper cover may be retained in the cover aperture on the base by passing the first and second pawl locks through the first and second retainer apertures. The anti-tamper cover may be formed from a plastic which is harder than the dry flexible plastic.

DETAILED DESCRIPTION

Figure 1A:
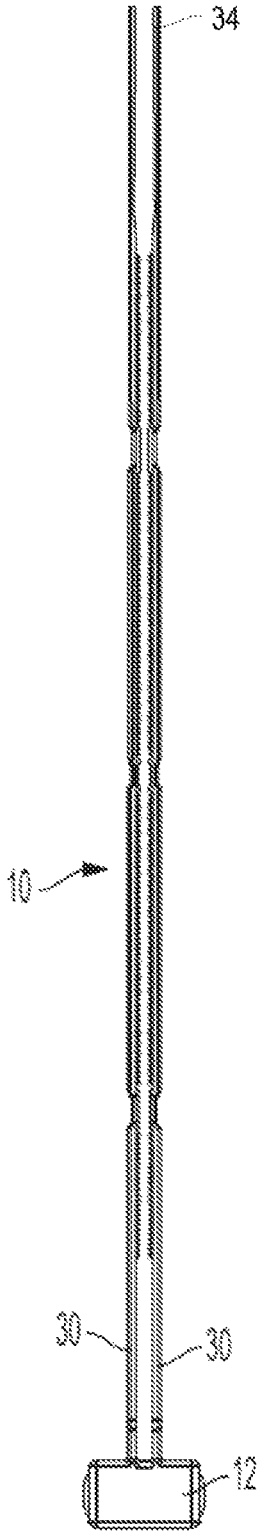
FIG. 1A is an illustration of one example a flexible restraint according to one aspect of the present invention.
Figure 1B:
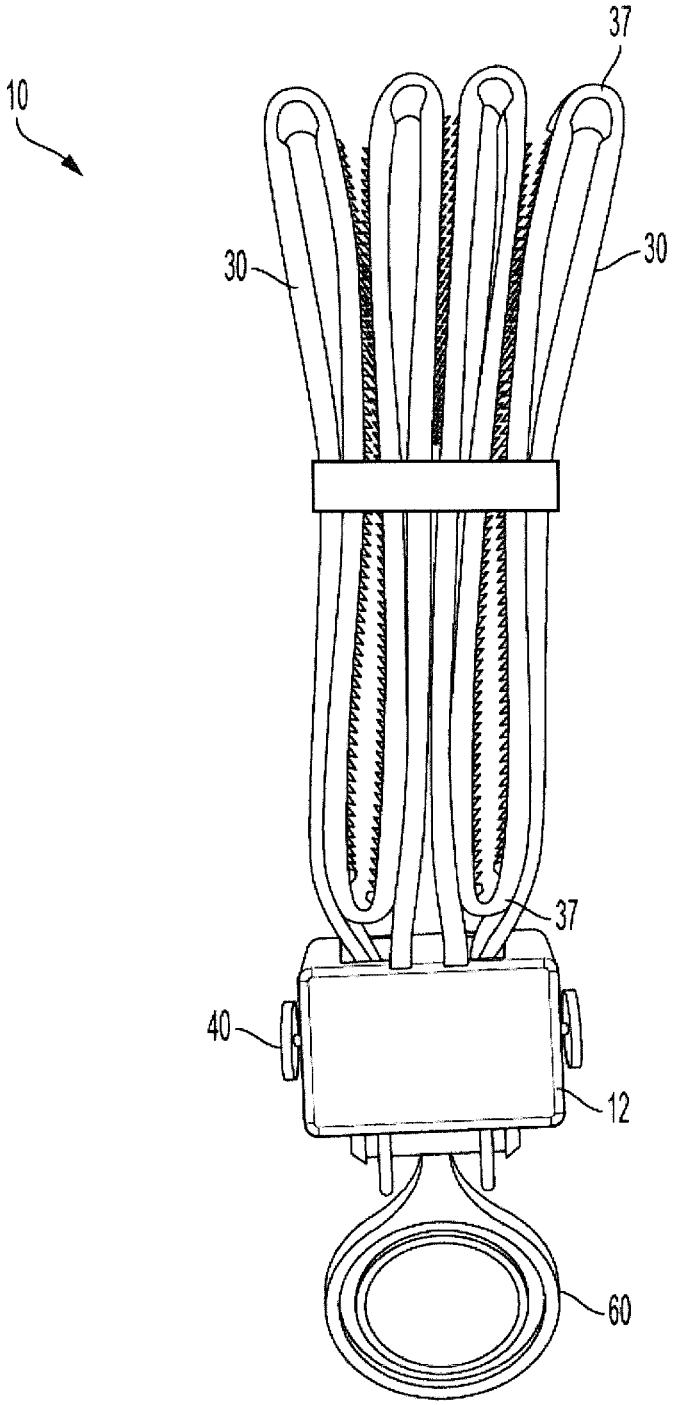
FIG. 1B is an illustration of the flexible restraint of FIG. 1A in a folded, ready-to-use state.

With reference to FIGS. 1A and 1B, a flexible locking restraint 10, according to one example of the present invention includes a base 12, at least one strap 30 extending therefrom, and at least one pawl lock 40. As illustrated in the figures, a flexible locking restraint 10 for use as a one-time use handcuff-style restraint includes two straps 30 and two pawl locks 40. To improve security, in one example, an anti-tamper cover 50 (FIGS. 2 and 3) may be included.

FIG. 1A illustrates a flexible locking restraint 10 in its as-molded configuration. FIG. 1B illustrates the flexible locking restraint 10 according to one example of the present invention in a folded, ready-to-use configuration. The straps 30 have been folded at flexible hinge points in a tri-fold fashion, and the distal ends of the straps 30 have been passed through the base 12. A pull ring 60 has been attached to the distal ends. Pawl locks 40 are in their unlocked position.

The base 12 and strap 30 are preferably integrally molded out of a dry flexible plastic. As used herein, "dry flexible plastic" does not necessary exclude all plastics having some potential to absorb water. Instead, "dry flexible plastic" means a plastic that does not require water conditioning to become flexible, i.e., the plastic has sufficient flexibility and lack of brittleness for use in a disposable restraint as described herein even in an as-molded state of dryness. In one example, the base 12 and strap 30 are molded from polyethylene. For example, the base 12 and strap 30 may be molded from low density polyethylene (LDPE). Other polyethylenes and plastics having sufficient flexibility and strength may also be used.

The base 12 may be shaped generally as a rectangular solid. The strap 30 has a proximal end 32 extending outwardly from a first side 14 of the base 12 and a distal end 34. A first strap surface 36 has one or more toothed portions 35. The teeth may be saw-tooth shaped. The teeth may be asymmetrical, with ramped surfaces facing the distal end 34 of the strap 30 and flat or vertical surfaces facing the proximal end 32 of the strap 30. The distal end 34 may be rounded or tapered. The distal end 34 may include an aperture for insertion of a draw ring 60. The strap 30 may also include flexible hinges 37 between the toothed portions to facilitate folding of the straps.

The base 12 includes a strap aperture 16 for the strap 30 and a pawl 22. The strap aperture 16 may be disposed on the first side 14 of the base 12 and near or at the proximal end 32 of the strap 30. The strap aperture 16 is dimensioned to accept the distal end of the strap 30. A lock aperture 18 is disposed on a second side 20 of the base 12. In the illustrated example the second side 20 is adjacent to and approximately 90° to the first side 14 of the base 12.

A pawl 22 extends inwardly from the first side 14 of the base 12 and has one surface facing the strap aperture 16 and another surface facing the lock aperture 18. A base of the pawl 22 may define one wall of the strap aperture 16. The surface of the pawl 22 facing the strap aperture 16 has teeth that are complementary to the teeth on the toothed portions 35 on the strap 30. The sawtooth shape of the complementary teeth allow the teeth to flex the pawl 22 away from the strap 30 during insertion of the strap 30 into the base 12, yet resist movement in the other direction. This provides unidirectional travel of the strap 30 through the base 12.

The pawl lock 40 has at least first and second retainers to engage the lock aperture 18 and retain the pawl lock 40 therein. The first retainer engages the pawl lock 40 into the lock aperture 18 in an unlocked position and the second retainer, which is spaced from the first retainer, engages the pawl lock 40 into the lock aperture 18 in a locked position. In the illustrated example (FIG. 3), the pawl lock 40 has a button head 46 and a shaft 48 extending therefrom. A first barb 42 and a second barb 44 spaced axially apart and encircling the shaft comprise the first and second retainers, respectively. Initially, the pawl lock 40 is inserted so that only the first barb 42 passes though the lock aperture 18, retaining the pawl lock 40 in the lock aperture 18. This is the unlocked state (FIG. 1B). In the unlocked state, the distal end of the strap 30 may be inserted into the strap aperture 16 with the first surface oriented toward the pawl 22 such that the toothed surfaces on each part engage each other, and the pawl 22 has sufficient freedom of movement to be flexibly pushed away from the strap 30 as the tips of the teeth pass each other. This allows the straps 30 to be pulled through the base 12 until loops formed by the straps 30 are tightened around the wrists of a detainee.

Figure 2:
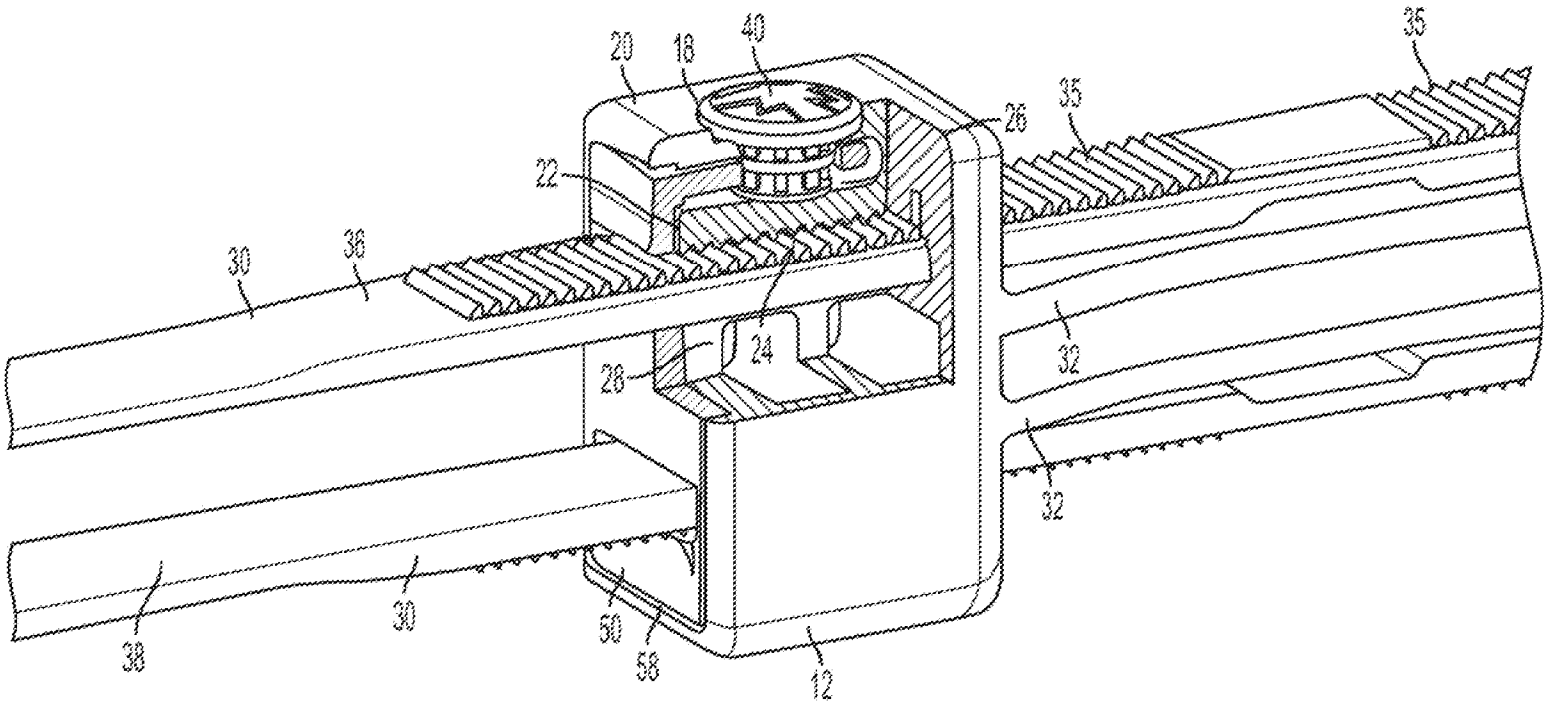
FIG. 2 is a partial perspective view of the flexible restraint of FIG. 1A in a deployed state, including a partial cross-sectional view.
Figure 3:
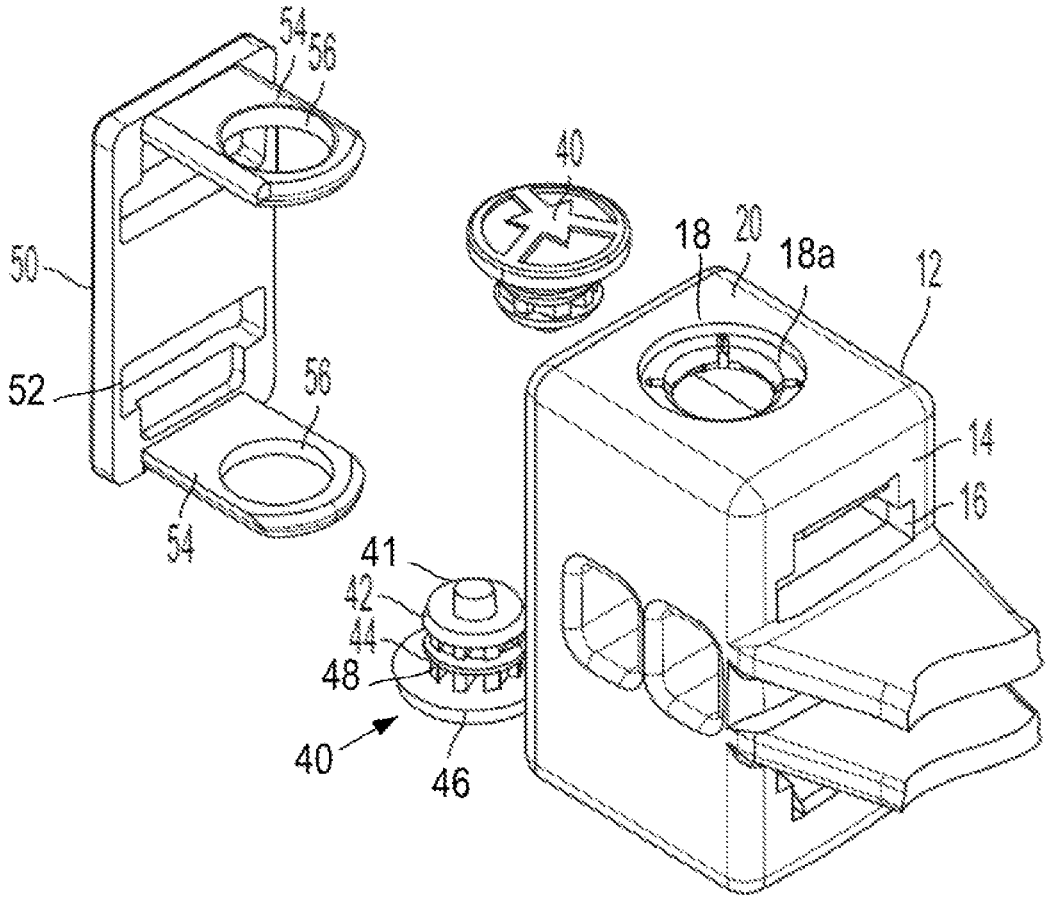
FIG. 3 is an exploded view of a base portion of a flexible restraint according to one aspect of the present invention.

After pulling the straps 30 through the base 12, the pawl lock 40 may be depressed such that the second barb 44 passes through the lock aperture 18 and retains the pawl lock 40 in the lock aperture 18 (FIG. 2). In this position, the pawl lock 40 engages the pawl 22 and presses the pawl 22 against the strap 30. This is the locked state. In the locked state, the strap 30 and pawl 22 are strengthened against brute force attempts to withdraw the strap 30 from the base 12. Up to 300 pounds of force or more may be required to forcibly remove the strap 30 when locked. This improves the security of the flexible locking restraint 10. Also, the effort required to tighten the strap 30 is greatly increased. This improves the safety of the flexible locking restraint 10, as it is less likely that a detainee will be injured by inadvertent over-tightening.

The lock aperture 18 may include a flexible recessed portion 18*a* with a thinned area and cutouts to improve flexibility. This facilitates the button barbs passing through the lock aperture 18 while being depressed, yet be resistant to backing out. This also allows for the button head to be flush or nearly flush with the surface of the base 12 when in the locked state. This reduces opportunities for tampering with the pawl lock 40 after being locked. The pawl lock 40 may also include a raised tip 41 which engages a recess in the pawl 22. This prevents the pawl lock 40 from sliding out of engagement with the pawl 22. Preferably, in the locked state, the pawl lock 40 should be resistant to tampering without tools.

In one example, the pawl lock 40 is molded from a hard durable plastic, such as acetal, marketed under the brand name Delrin. Plastics such as acetal are harder than LDPE. The harder plastic of the buttons may compress the relatively softer polyethylene of the pawls 22 and straps 30, and force the teeth of those components to interlock. In one example, the pawl locks 40 are molded from plastic having a different color than the base 12 and strap 30. Visual contrast provides a prompt or reminder to depress the pawl locks 40 after tightening the straps 30. Also, while the foregoing example includes barbs which fully encircle the shaft, other structural features, such as partially encircling barbs, threads, or teeth, may be provided to allow the pawl lock 40 to be retained in an unlocked state on the base 12 prior to use and then actuated into a locked position to secure a flexible restraint while in use.

Due to the relative softness of polyethylene, additional security against tampering and unauthorized release may be provided by including a cover to protect the pawls 22. For example, the base 12 may be formed with cover recess 58 opposite the side of the base 12 where the straps 30 and strap apertures 16 are located, and an anti-tamper cover 50 may be inserted therein. The anti-tamper cover 50 may be molded out of a hard, durable plastic such as acetal. The anti-tamper cover includes strap exit apertures 52 which are dimensioned to allow the straps 30 to pass through, but prevent most tools or shims from passing through in an attempt to release the pawls 22 from the straps 30. The anti-tamper cover 50 includes retainers 54, each having a retainer aperture 56. The retainer apertures 56 align with the lock apertures 18 when the anti-tamper cover 50 is inserted into the base 12. The anti-tamper cover 50 may be placed in the cover recess 58 and the pawl lock 40 pressed into the base 12 to its unlocked state through the lock apertures 18. This also pushes the shaft 48 of the pawl lock 40 through the retainer apertures 56, retaining the anti-tamper cover 50 in place without the need for tools, or adhesives.

The descriptions and illustrations provided herein are meant to be illustrative and not limiting. It will be understood that the flexible restraints of the present invention can be modified without departing from the teachings of the invention. Accordingly, the scope of the invention is only to be limited as necessitated by the accompanying claims.

What is claimed is:

1. A flexible locking strap, comprising:

a base and at least one strap integrally molded of a dry flexible plastic, the strap extending outwardly from a first side of the base and having a proximal end and a distal end;

the strap further having a first surface and a second surface, the first surface comprising at least one toothed portion;

the base further comprising:

a strap aperture disposed on the first side of the base proximate to the proximal end of the strap and being dimensioned to accept the distal end of the strap;

a lock aperture disposed on a second side of the base;

a pawl extending inwardly from the first side of the base and having a first surface facing the strap aperture and a second surface facing the lock aperture, the first surface of the pawl comprising a toothed surface to cooperate with the toothed portions of the strap; and a pawl lock disposed in the lock aperture, the pawl lock comprising a button with a button head and a shaft, the shaft having first and second barbs to engage the lock aperture, where the first barb is spaced from the second barb along a length of the shaft;

wherein when the pawl lock is depressed such that the first retainer retains the pawl lock in the lock aperture and the distal end of the strap is inserted into the strap aperture with the first surface oriented toward the pawl such that the toothed portion of the strap and the toothed surface of the pawl engage, the pawl has sufficient freedom of movement to allow unidirectional movement of the strap through the base, and wherein when the pawl lock is depressed such that the second retainer retains the pawl lock in the lock aperture, the pawl lock engages the pawl and presses the pawl against the strap.

2. The flexible locking strap of claim 1, wherein the lock aperture further comprises a recessed portion to facilitate pawl lock barb passage and to receive at least a portion of the button head.

3. The flexible locking strap of claim 1, wherein the pawl lock is formed from plastic which is harder than the dry flexible plastic.

4. The flexible locking strap of claim 1, further comprising a hard plastic anti-tamper cover disposed on a third side of the base opposite from the first side of the base.

5. The flexible locking strap of claim 4, wherein the dry flexible plastic is polyethylene and the hard plastic of anti-tamper cover is acetal.

6. The flexible locking strap of claim 1, wherein the first surface of the strap comprises a plurality of toothed portions, the strap further comprising at least one flexible hinge portion between toothed portions.

7. The flexible locking strap of claim 1, wherein the pawl comprises one side of the strap aperture.

8. The flexible locking strap of claim 1, wherein the dry flexible plastic is low density polyethylene.

9. A flexible locking restraint, comprising:

a base and first and second straps integrally molded of a dry flexible plastic, the first and second straps each extending outwardly from a first side of the base and having a proximal end and a distal end;

each strap further having a first surface and a second surface, the first surface comprising at least one toothed portion;

the base further comprising:

first and second strap apertures disposed on the first side of the base proximate to the proximal ends of the first and second straps, respectively and being dimensioned to accept the distal end of their respective strap;

a first lock aperture disposed on a second side of the base;

a second lock aperture disposed on a third side of the base opposite the second side of the base;

a first pawl extending inwardly from the first side of the base and having a first surface facing the first strap aperture and a second surface facing the first lock aperture, the first surface of the pawl comprising a toothed surface to cooperate with the toothed portions of the first strap;

a second pawl extending inwardly from the second side of the base and having a first surface facing the second strap aperture and a second surface facing the second lock aperture, the first surface of the pawl comprising a toothed surface to cooperate with the toothed portions of the second strap; and a first pawl lock disposed in the first lock aperture and a second pawl lock disposed in the second lock aperture, each pawl lock having first and second retainers to engage their respective lock apertures, where the first retainer is spaced from the second retainer along a length of the pawl lock;

wherein when the pawl locks are depressed such that the first retainer retains each pawl lock in its respective lock aperture and the distal ends of the straps are inserted into their respective strap apertures with the first surfaces oriented toward the pawls such that the toothed portion of the strap and the toothed surface of the pawl engage, the pawls have sufficient freedom of movement to allow unidirectional movement of the straps through the base, and wherein when the pawl locks are depressed such that the second retainer retains each pawl lock in its respective lock aperture, the pawl lock engages the pawl and presses the pawl against the strap.

10. The flexible locking strap of claim 9, wherein each pawl lock comprises a button with a button head and a shaft, and the first and second retainers comprise first and second barbs disposed on the shaft.

11. The flexible locking strap of claim 10, wherein the first and second barbs completely encircle the shaft.

12. The flexible locking restraint of claim 10, wherein each pawl lock is formed from a plastic which is harder than the dry flexible plastic.

13. The flexible locking restraint of claim 10, wherein each pawl lock is formed from a plastic which is a different color from the dry flexible plastic.

14. The flexible locking restraint of claim 9, wherein a cover recess is provided on the base opposite from the first side of the base, the flexible locking strap further comprising an anti-tamper cover disposed in the cover aperture, the anti-tamper cover further comprising first and second strap exit apertures positioned to pass the first and second straps, respectively.

15. The flexible locking restraint of claim 14, wherein each pawl lock comprises a button with a button head and a shaft, and the first and second retainers comprise first and second barbs disposed on the shaft, and wherein the anti-tamper cover further comprises first and second cover retainers, each having a retainer aperture, wherein the anti-tamper cover is retained in the cover aperture on the base by passing the first and second pawl locks through the first and second retainer apertures.

16. The flexible locking restraint of claim 15, wherein the anti-tamper cover is formed from a plastic that is harder than the dry flexible plastic.

17. The flexible locking restraint of claim 16, wherein the dry flexible plastic is low density polyethylene.

18. The flexible locking restraint of claim 17, wherein the anti-tamper cover is formed from acetal.

* * * * *